US011439962B2

(12) United States Patent
Huang et al.

(10) Patent No.: US 11,439,962 B2
(45) Date of Patent: Sep. 13, 2022

(54) SYSTEM FOR CONTINUOUS MAKE-DOWN OF POWDER MATERIAL

(71) Applicant: Ecolab USA Inc., St. Paul, MN (US)

(72) Inventors: Cheng-Sung Huang, Naperville, IL (US); Shahin Zarghamin, Westmont, IL (US); Larry G. Triplett, Berwyn, IL (US); Heqing Huang, Naperville, IL (US)

(73) Assignee: Ecolab USA Inc., St. Paul, MN (US)

( * ) Notice: Subject to any disclaimer, the term of this patent is extended or adjusted under 35 U.S.C. 154(b) by 287 days.

(21) Appl. No.: 16/811,689

(22) Filed: Mar. 6, 2020

(65) Prior Publication Data

US 2020/0282367 A1 Sep. 10, 2020

Related U.S. Application Data

(60) Provisional application No. 62/815,118, filed on Mar. 7, 2019.

(51) Int. Cl.
*B01F 27/00* (2022.01)
*B01F 35/00* (2022.01)
(Continued)

(52) U.S. Cl.
CPC ..... *B01F 27/091* (2022.01); *B01F 21/02* (2022.01); *B01F 21/10* (2022.01); *B01F 21/15* (2022.01);
(Continued)

(58) Field of Classification Search
CPC ..... B01F 35/22141; B01F 21/503; B01F 27/091; B01F 27/1125; B01F 21/10;
(Continued)

(56) References Cited

U.S. PATENT DOCUMENTS 3,644,103 A 2/1972 Yoon et al.
4,444,508 A * 4/1984 Kreuer ..... B01F 33/70 366/139
(Continued)

FOREIGN PATENT DOCUMENTS

CN 109107457 A 1/2019
WO WO 02/092206 A2 11/2002

OTHER PUBLICATIONS

European Patent Office, International Search Report in International Patent Application No. PCT/US2020/021449, 13 pp. (dated Jun. 24, 2020).
(Continued)

*Primary Examiner* — Anshu Bhatia
(74) *Attorney, Agent, or Firm* — Leydig, Voit & Mayer, Ltd.

(57) ABSTRACT

A system for continuously making-down a dry powder material is provided. The system may include a liquid supply system, a material feed system, a vessel, a filter, and an agitator. The vessel may receive a continuous supply of liquid from the liquid supply system and a continuous supply of dry powder from the material feed system. The liquid and material may be discharged continuously from the vessel. A filter may sealingly extend across the outlet to filter the solution exiting the vessel. The filter may include an upstream surface in contact with the inner volume of the vessel. The agitator may be disposed within the vessel and may be configured to agitate the contents of the vessel. The agitator may include a wiping member configured to contact the upstream surface of the filter while agitating the contents.

25 Claims, 3 Drawing Sheets

(51) Int. Cl.

| | |
|---|---|
| ***B01F 27/091*** | (2022.01) |
| ***B01F 21/00*** | (2022.01) |
| ***B01F 21/10*** | (2022.01) |
| ***B01F 27/192*** | (2022.01) |
| ***B01F 27/1125*** | (2022.01) |
| ***B01F 35/21*** | (2022.01) |
| ***B01F 35/221*** | (2022.01) |
| *B01F 101/00* | (2022.01) |

(52) U.S. Cl.
CPC ..... *B01F 27/1125* (2022.01); *B01F 27/192* (2022.01); *B01F 35/2113* (2022.01); *B01F 35/2132* (2022.01); *B01F 35/22141* (2022.01); *B01F 21/503* (2022.01); *B01F 2101/2805* (2022.01)

(58) Field of Classification Search
CPC .... B01F 21/15; B01F 35/2113; B01F 27/192; B01F 21/02; B01F 35/2132; B01F 2101/2805
See application file for complete search history.

(56) References Cited

U.S. PATENT DOCUMENTS

| | | | | |
|---|---|---|---|---|
| 6,039,470 | A | 3/2000 | Conwell | |
| 7,866,881 | B2 * | 1/2011 | El Kholy | B01F 25/3121 366/163.2 |
| 10,167,240 | B1 | 1/2019 | Humic | |
| 2004/0234677 | A1 * | 11/2004 | Sato | B01F 27/85 366/279 |

OTHER PUBLICATIONS

European Patent Office, Written Opinion in International Patent Application No. PCT/US2020/021449, 8 pp. (dated Jun. 24, 2020).

* cited by examiner

SYSTEM FOR CONTINUOUS MAKE-DOWN OF POWDER MATERIAL

CROSS-REFERENCE TO RELATED APPLICATIONS

This patent application claims the benefit of U.S. Provisional Patent Application No. 62/815,118, filed Mar. 7, 2019, which is incorporated herein by reference for all purposes.

TECHNICAL FIELD

The present disclosure relates generally to systems for making-down dry powder material. The system may include a system for continuous make-down of powder material, and may further include a mechanism for cleaning a filter of the system.

BACKGROUND

One manner of dissolving dry powder materials such as polymers (i.e., make-down) utilizes batch processes in which powder material is added to a stirred tank of a liquid or solvent (e.g., water) and the mixture is stirred until the powder material has completely or nearly completely dissolved. The process can take several minutes to hours depending on several factors. The tanks required for operating with batch processes can include a fairly large footprint.

In a continuous make-down process, dry powder particles are continuously charged into a tank, a solvent such as water continuously flows into the tank, and the solution is continuously discharged. As a result, some particles within the mixing tank may not be fully dissolved. This increases the likelihood that the fluid flowing from the mixing tank may include undissolved polymers that may have a negative impact on subsequent operations using the solution.

It will be appreciated that this background description has been created by the inventor to aid the reader in understanding the invention in terms of certain advantages, and not as an admission that any of the indicated problems were themselves appreciated in the art.

SUMMARY

In one aspect, the present invention provides an apparatus for continuous make-down of a material, which apparatus includes a liquid supply system, a material feed system, a vessel, a filter, and an agitator. The liquid supply system may include a pump operative to provide a continuous supply of liquid. The material feed system may be operative to provide a continuous supply of dry powder of the material. The vessel preferably defines an inner volume configured to contain a volume of liquid and includes an inlet and an outlet. The inlet is preferably in fluid communication with the liquid supply system and the inner volume, and is preferably configured to receive liquid from the liquid supply system and the dry powder from the material feed system. The outlet may be in fluid communication with the inner volume. The filter sealingly may extend across the outlet whereby liquid exiting the vessel through the outlet passes through the filter. The filter preferably has an upstream surface in contact with the inner volume. The agitator is preferably disposed within the vessel and is preferably configured to agitate the inner volume. The agitator may include a wiping member configured to contact the upstream surface of the filter, e.g., while agitating the inner volume.

In another aspect, the present invention provides a method of continuous make- down of material, which method includes continuously delivering a liquid to a wetting unit, continuously delivering a dry powder of the material to the wetting unit, wetting the dry powder with the liquid to form a mixture which may be in the form of, e.g., a slurry, suspension, solution, or combination thereof, of the material and the liquid, and delivering the mixture (e.g., as a slurry) to an inner volume of a vessel. The method may further include continuously agitating the mixture (e.g., as a slurry) contained in the inner volume of the vessel to form a solution, continuously removing a discharge volume of the solution contained in the inner volume of the vessel while passing the discharge volume through a filter and through an outlet of the vessel, with the filter having an upstream surface in contact the inner volume of the vessel, and wiping the upstream surface of the filter while agitating the mixture (e.g., as a slurry).

It should be understood that the drawings are not necessarily to scale and that the disclosed embodiments are illustrated diagrammatically and in partial views. In certain instances, details which are not necessary for an understanding of this disclosure or which render other details difficult to perceive may have been omitted. It should also be understood that this disclosure is not limited to the particular embodiments illustrated herein.

DETAILED DESCRIPTION OF EXEMPLARY EMBODIMENTS

Figure 1:
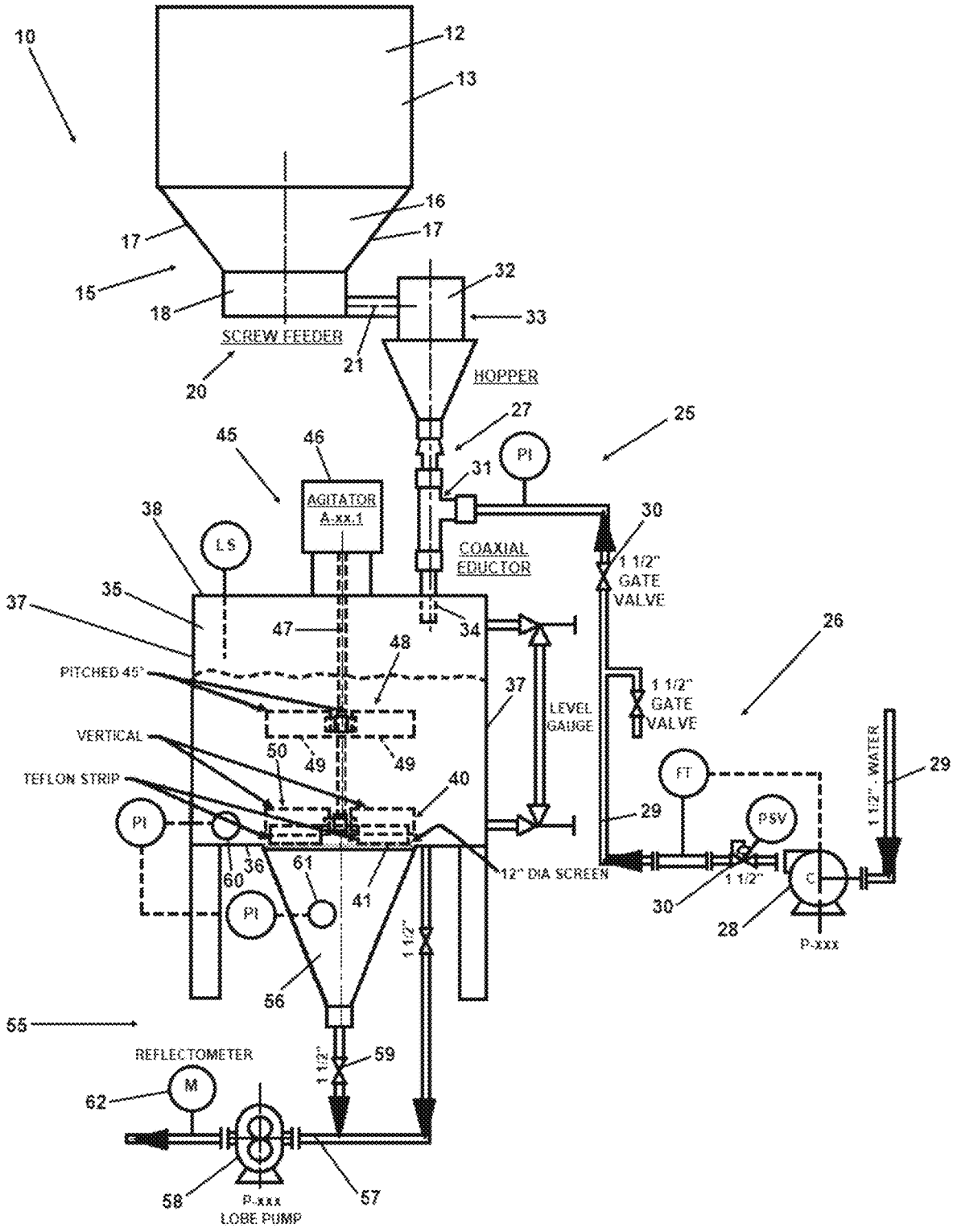
FIG. 1 is a diagrammatic view of a system for processing a dry powder material and forming a homogeneous liquid solution.

Referring to FIG. 1, a system 10 for continuously processing a powder material, such as a dry polymer, to form a homogeneous liquid solution is depicted. The system 10 comprises a container 12, a material feed system 15, a material wetting system 25, a vessel or tank 35, an agitator 45, and a discharge system 55.

The container 12 is configured to contain and deliver a flowable, dry powder material such as a dry polymer. Examples of such dry powder material include associatively networked polymer(s) of low molecular weight, high molecular weight cationic flocculant polymer(s), high molecular weight anionic flocculant polymer(s), and the like, and combinations thereof. It will be appreciated that suitable dry polymers may include those used in such industries as, e.g., paper processing, mining, waste water, and energy.

In some embodiments, the dry powder material includes associatively networked polymer(s) of low molecular weight (e.g., from about 10 kDa to about 5,000 kDa or from about from about 10 kDa to about 2,000 kDa). Examples of such polymers include polymers disclosed in U.S. Patent Application Publication No. 2017/0355846. In some embodiments, the dry powder material includes high molecular weight cationic flocculant polymer(s) or high molecular weight anionic flocculant polymer(s). In some embodiments, the high molecular weight cationic flocculant is a cationic (e.g., DMAEA.MCQ, DADMAC, etc.) acrylamide-based polymer, such as, for example, GR-503 (45 mol % cationic DMAEA.MCQ/acrylamide). In some embodiments, the high molecular weight anionic flocculant polymer is an anionic (e.g., acrylic acid, methacrylic acid, etc.) acrylamide-based polymer, such as, for example, GR-602 (35 mol% anionic acrylic acid/acrylamide).

The container 12 may have any desired configuration. In an example, the container 12 may have a closed body section 13 with an opening (not shown) at the bottom through which the material within the container may be discharged.

The material feed system 15 includes a hopper 16 having sloped sidewalls 17 that lead and funnel material to a material feed housing 18. A material feed mechanism generally indicated at 20 such as, e.g., a screw feed mechanism (e.g., an auger) is disposed within the material feed housing 18 and directs material from the housing out the material feed tube 21.

The material wetting system 25 includes a liquid supply system 26 and an eductor 27. The liquid supply system 26 includes a supply pump 28, a liquid supply line 29 and one or more supply control valves 30 to control the flow through the liquid supply line. A solvent or liquid such as water is provided through the liquid supply line 29 into the fluid inlet 31 of the eductor 27. The end of the material feed tube 21 is positioned within a housing 32 above the eductor 27 and aligned with the opening at the top 33 of the eductor 27 (that operates as a powder material inlet of the eductor) so that material falling from the material feed tube enters the eductor. In one embodiment, the eductor 27 may be configured as a coaxial eductor.

Other manners of providing fluid and/or powder material to the tank 35 are contemplated. For example, other types of eductors may be used. Further, an additional liquid inlet to the tank 35 may be provided for liquid that does not flow through the eductor 27.

The vessel or tank 35 has a lower surface 36, a plurality of sidewalls 37 that extend upwardly from the lower surface and an open top 38. The lower end or outlet 34 of the eductor 27 is disposed over the open top 38 of the tank 35 to permit the mixture of powder material and fluid exiting the eductor to be fed by gravity or by the water pressure resulting from the supply pump 28 into the tank where it is mixed with additional fluid as part of the make-down process. The lower surface 36 of the tank 35 includes a centrally located outlet 40. The lower surface 36 and the sidewalls 37 of the tank define an inner volume configured to contain a volume of liquid.

Figure 2:
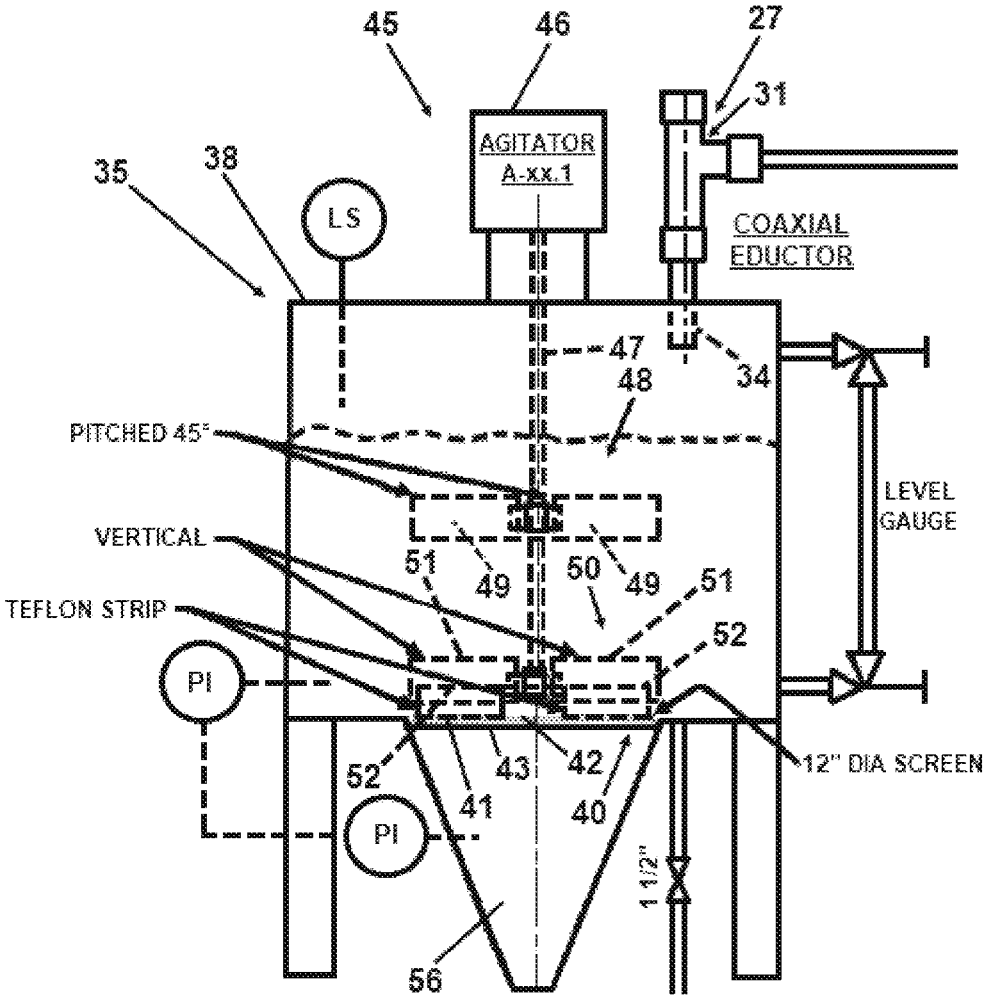
FIG. 2 is an enlarged diagrammatic view of the tank of the system of FIG. 1.

A filter 41 is positioned over the outlet 40 to sealingly extend over the outlet so that any fluid exiting the tank 35 passes through the filter. The filter 41 has an upstream side or surface 42 (FIG. 2) and an opposite, downstream side or surface 43 with a plurality of openings or pores extending between the upstream side and the downstream side. The openings or pores of the filter 41 may be sized so that particles of the powder material will not pass through the filter until they have been sufficiently dissolved. For example, as the particles of powder material move within the tank 35, they may dissolve and/or may become smaller in size. As a result, while the particles may not initially pass through the filter 41, as they dissolve, they eventually will be able to pass through the filter.

Figure 3:
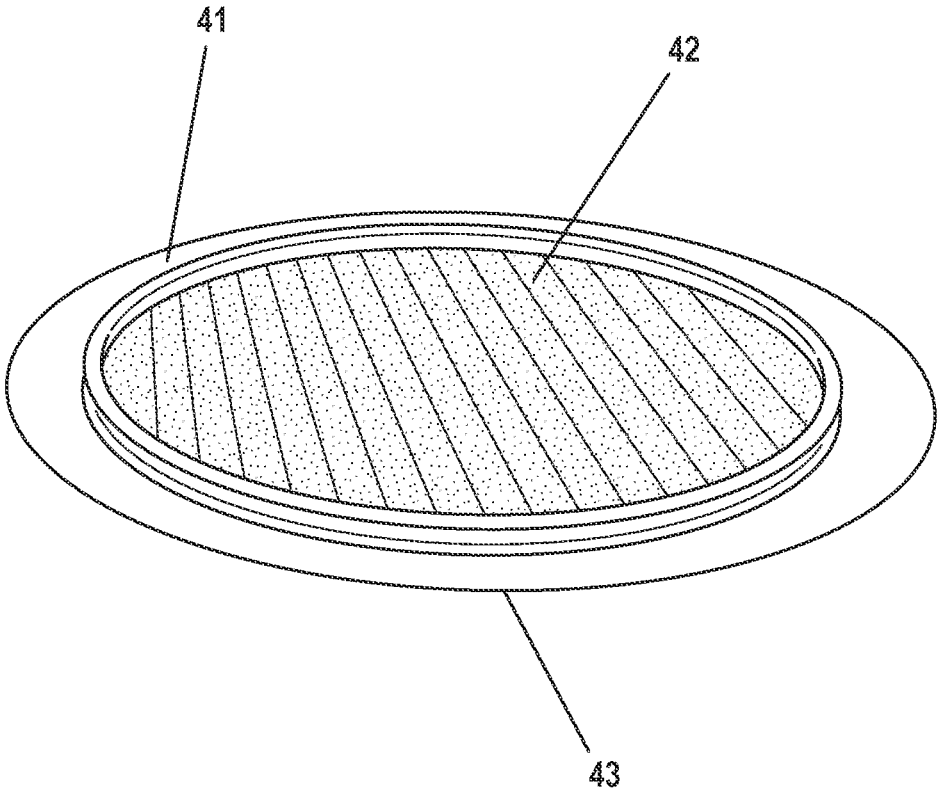
FIG. 3 is a perspective view of a filter for use with the system disclosed herein.

The filter 41 may have any desired configuration and size. For example, referring to FIG. 3, the filter 41 may be round with a diameter of 12 inches and have a 200 μm pore size. In another embodiment, the filter 41 may be round with a diameter of 12 inches and have a 150 μm pore size. Other sizes and configurations are contemplated. The size and configuration may depend on the type of filter 41. The filter 41 may be formed of a plurality of wires having a wedge-shaped cross section that are widest at the upstream side 42 of the filter and narrower at the downstream side 43 of the filter to minimize clogging or blinding of the filter.

The agitator or mixing system 45 includes a motor 46 disposed above the tank 35 that is operatively connected to a vertical drive shaft 47. A first or upper impeller 48 includes a first set of upper impeller blades 49 mounted on and operatively connected to the vertical drive shaft 47 so that rotation of the motor 46 rotates the upper impeller blades. In one embodiment, the first set includes four 12" upper impeller blades 49 with each blade having a 45° pitch. As depicted, the upper impeller blades 49 may be disposed approximately halfway between the lower surface 36 and the open top 38 of the tank 35.

A second or lower impeller 50 includes a second set of lower impeller blades 51 mounted on and operatively connected to the vertical drive shaft 47 so that rotation of the motor 46 rotates the lower impeller blades. In an embodiment, the second set includes six 12" lower impeller blades 51. Some or all of the lower impeller blades 51 may include a flexible lower surface or strip 52 that acts as a wiper to sweep the upper surface of the filter 41. In one embodiment, a strip 52 of flexible material such as fluoropolymer may be disposed on two of the six lower impeller blades 51. The lower impeller blades 51 may be positioned so that the strips 52 sweep away polymer particles that may adhere to the inner surface of the filter 41 to prevent or reduce the likelihood of the filter becoming blinded by fine polymer particles.

The discharge system 55 includes a discharge member 56 fluidly connected to the tank 35 below the outlet 40 so that fluid exiting the tank flows through the discharge member. The discharge member 56 is fluidly connected to a discharge line 57 and is directed to a further location by discharge pump 58. One or more discharge control valves 59 may be provided to control the flow through the discharge line 57. In one embodiment, the discharge member may have an inverted frusto-conical or cone shaped to direct the flow of discharge solution from the relatively large outlet 40 and the downstream surface 43 of the filter 41 to the discharge line 57.

A first pressure sensor 60 may be provided within the tank 35 adjacent the outlet 40, and a second pressure sensor 61 may be provided within the discharge member 56. The upper portion of the discharge member 56 may be configured to accommodate the second pressure sensor 61. A pressure differential between the first pressure sensor 60 and the second pressure 61 may be used to determine the extent to which the filter 41 is blinded by powder material at the upstream side 42 of the filter. For example, with no pressure differential between the upstream side 42 of the filter 41 and the downstream side 43, fluid may freely flow through the filter. However, if there is a pressure differential across the filter 41, the filter may risk becoming blinded by undissolved polymer particles blocking the flow through the filter. In such case, it may be desirable to control the operation of the supply control valves 30 and/or the discharge control valve 59 to control the flow into and out of the tank 35.

A concentration-measuring detector 62 may be provided along the discharge system 55 to detect the concentration of the polymer present in the liquid (e.g., dilute aqueous solution) exiting the tank 35 through the filter 41. In one embodiment, the concentration measuring detector may comprise a reflectometer.

Alternatively, the outlet may be disposed on a sidewall 37 of the tank 35 below the level 39 of the solution. The operation of discharge pump 58 may create a vacuum sufficient to draw a volume of the solution from the outlet. With the outlet along a sidewall 37, the filter 41 is positioned to filter all of the liquid that exits from the outlet. However, the wiper may not be secured to the lower impeller blades 51. Instead, a separate wiping system (not shown) that operates to periodically wipe the upstream surface 42 of the filter 41 may be used. In one embodiment, the system may be a rotary system or a reciprocating system similar to an automotive windshield wiper system.

In one embodiment, the system 10 may be configured to operate continuously and simultaneously to optimize performance of the make-down system. In doing so, supply pump 28 may be operated to cause liquid to flow through the liquid supply line 29 to the eductor 27. While the liquid is supplied to the eductor, the material feed mechanism 20 may provide a supply of powder material through the material feed tube 21 that falls into the center of the eductor 27. The flow of fluid, air, and powder material may be configured to cause the powder material and fluid to mix while minimizing or reducing any clumping of the powder material. The mixture, e.g., slurry, of powder material and fluid exits the eductor 27 and flows or is charged into the tank 35 where it is mixed with the existing liquid within the tank.

Power may be provided to the motor 46 of the agitator 45 to rotate the drive shaft 47. Rotation of the drive shaft 47 causes rotation of the upper impeller blades 48 and the lower impeller blades 50 which results in mixing of the mixture, e.g., slurry and/or solution, within the tank 35. As the liquid within the tank 35 is mixed, the powder material may continue to dissolve resulting in a reduction in size and/or dissolution of the polymer particles. Rotation of the lower impeller blades 51 causes the flexible strips 52 to contact the upstream surface 42 of the filter 41 to sweep away polymer particles that may have adhered to the upstream surface to prevent or reduce the likelihood that the filter will be blinded by the polymer particles.

Fluid may continuously exit the tank 35 through the filter 41 disposed above the discharge member 56. The flow rate of the fluid through the discharge line 57 may be controlled by the operation of the discharge pump 58. The pressure differential between the first pressure sensor 60, located within the tank 35, and the second pressure sensors 61, located at the discharge member 56, may be monitored to determine the extent to which the filter 41 is blinded by undissolved polymer particles that are adhering to the upstream surface 42, The operation of the supply pump 28 and the discharge pump 58 may be coordinated to control the flow rate 57 to reduce blinding of the filter 41.

The following examples further illustrate the invention but, of course, should not be construed as in any way limiting its scope.

For each example, a 2'×2'×2.5' tank 35 with a 75-gallon capacity was used. The agitator 45 included a 3 ½ HP motor 46, the upper impeller 48 of the agitator 45 was a 12-inch Lightnin A200 type impeller 48 with four 45° -pitched blades 49, and the lower impeller 50 was a 12-inch Lightnin R100 type impeller with six vertical blades 51 and with the flexible strips 52 disposed on two of the lower blades. The control valve of the liquid supply line 29 was adjusted to provide a back pressure of 60 psig and a flow rate of between four and 10 gallons per minute. The tank volume was maintained at 55 gallons by adjusting the discharge rate to match the water and polymer feed rates. A sample of 200 g was taken from the outgoing stream and poured into a 3 inch 100-mesh sieve to determine the amount of undissolved polymer particles. The percentage of the surface area of the sieve covered by undissolved polymer particles is termed the "gel" number of that sample.

EXAMPLE 1

The polymer utilized for Example 1 was Ultis polymer (U.S. Patent Publication No. 2017/0355846) having a maximum particle size of 500 μm. The filter 41 had a pore size of 150 μm.

TABLE 1

| Tap water federate (gpm) | Polymer federate (lbs/min) | % polymer concentration | Temp (° F.) | Agitator speed (rpm) | Residence time (min) | Pressure up/below screen ("Hg) | Gel # | Viscosity (cps) |
|---|---|---|---|---|---|---|---|---|
| 6 | 0.5 | 1 | 71 | 225 | 9 | 0/0 | 0.5 | 180 |
| 6 | 0.5 | 1 | 71 | 225 | 9 | 0/0 | 0.5 | 190 |
| 8 | 0.67 | 1 | 77 | 225 | 7 | 0/0 | 0.5 | 187 |
| 8 | 0.67 | 1 | 77 | 225 | 7 | 0/0 | 0.5 | 188 |

As is apparent from the results set forth in Table 1, a dissolution rate of 0.67 pounds per minute could be achieved with a residence time in the tank of seven minutes. This suggests that a 300 gallon continuous make-down system could dissolve approximately 4000 pounds of Ultis polymer per day. In contrast, to dissolve 4000 pounds per day using a batch process, two 1000 gallon tanks would be required.

EXAMPLE 2

The polymer utilized for Example 2 was Ultis polymer having a maximum particle size of 700 μm. The filter 41 had a pore size of 200 μm.

TABLE 2

| Tap water feed rate (gpm) | Polymer feedrate (lbs/min) | % polymer | Temp (° F.) | Agitator (rpm) | Residence time (min) | Pressure up/below screen ("Hg) | Gel # | Viscosity (cps) |
|---|---|---|---|---|---|---|---|---|
| 5 | 0.42 | 1 | 73 | 225 | 11 | 0/0 | 0 | 156 |
| 5 | 0.42 | 1 | 72 | 150 | 11 | 0/0 | 2 | 185 |
| 6 | 0.50 | 1 | 71 | 180 | 9 | 0/0 | 2 | 150 |
| 8 | 0.67 | 1 | 71 | 180 | 7 | 0/12 | 5 | 159 |

As is apparent from the results set forth in Table 2, a dissolution rate of 0.5 pounds per minute could be achieved with a residence time in the tank of nine minutes. Increasing the Ultis feed rate to 0.67 pounds per minute resulted in a pressure drop across the filter 41 to twelve inches of mercury, indicating that the filter was partially blinded.

EXAMPLE 3

The polymer utilized for Example 3 was Ultis polymer having a maximum particle size of 1000 μm. The filter 41 had a pore size of 200 μm.

TABLE 3

| Tap water feed rate (gpm) | Polymer feed rate (lbs/min) | % polymer | Temp (° F.) | Agitator (rpm) | Residence time (min) | Pressure up/below screen ("Hg) | Gel # | Viscosity (cps) |
|---|---|---|---|---|---|---|---|---|
| 4 | 0.34 | 1 | 77 | 224 | 14 | 0/0 | 0 | 187 |

As is apparent from the results in Table 3, a dissolution rate of 0.34 pounds per minute could be achieved with a residence time in the tank of fourteen minutes.

EXAMPLE 4

The polymer utilized for Example 4 was a cationic flocculant polymer (GR-503) having a maximum particle size of 425 μm. The filter 41 had a pore size of 200 μm.

TABLE 4

| Tap water feed rate (gpm) | Polymer feed rate (lbs/min) | % polymer | Temp (° F.) | Agitator (rpm) | Residence time (min) | Pressure up/below screen ("Hg) | Gel # | Viscosity (cps) |
|---|---|---|---|---|---|---|---|---|
| 5 | 0.21 | 0.5 | 77 | 225 | 11 | 0/0 | 2 | 356 |
| 5 | 0.3 | 0.75 | 77 | 180 | 11 | 0/0 | 1 | 625 |
| 5 | 0.3 | 0.75 | 77 | 180 | 11 | 0/0 | 1 | 625 |
| 5 | 0.42 | 1 | 77 | 180 | 11 | 0/0 | 1 | 969 |
| 6 | 0.38 | 0.75 | 77 | 225 | 9 | 0/0 | 2 | 980 |
| 6 | 0.38 | 0.75 | 77 | 180 | 9 | 0/0 | 2 | 846 |

As is apparent from the results in Table 4, a dissolution rate of 0.38 pounds per minute could be achieved with a residence time in the tank of nine minutes.

EXAMPLE 5

The polymer utilized for Example 5 was an anionic flocculant polymer (GR-602 and) having a maximum particle size of 425 μm. The filter 41 had a pore size of 200 μm.

TABLE 5

| Tap water feed rate (gpm) | Polymer feed rate (lbs/min) | % polymer | Temp (° F.) | Agitator (rpm) | Residence time (min) | Pressure up/below screen ("Hg) | Gel # | Viscosity (cps) |
|---|---|---|---|---|---|---|---|---|
| 5 | 0.104 | 0.25 | 77 | 225 | 11 | 0/0 | 5 | 291 |
| 4 | 0.083 | 0.25 | 77 | 225 | 14 | 0/0 | 2 | 331 |
| 4 | 0.167 | 0.5 | 77 | 225 | 14 | 0/0 | 5 | 880 |
| 4 | 0.167 | 0.5 | 77 | 182 | 14 | 0/0 | 5 | 900 |

As is apparent from the results in Table 5, a dissolution rate of 0.083 pounds per minute could be achieved with a residence time in the tank of fourteen minutes.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. An apparatus for continuous make-down of a material, the apparatus comprising:

a liquid supply system including a pump operative to provide a continuous supply of liquid;

a material feed system operative to provide a continuous supply of dry powder of the material;

a vessel defining an inner volume configured to contain a volume of liquid, the vessel including an inlet and an outlet, the inlet being in fluid communication with the liquid supply system and the inner volume, the inlet being configured to receive liquid from the liquid supply system and the dry powder from the material feed system, the outlet being in fluid communication with the inner volume;

a filter sealingly extending across the outlet whereby liquid exiting the vessel through the outlet passes through the filter, the filter having an upstream surface in contact with the inner volume; and an agitator disposed within the vessel and configured to agitate the inner volume, the agitator including a wiping member configured to contact the upstream surface of the filter while agitating the inner volume.

2. The apparatus of claim 1, wherein the wiping member comprises at least one strip of flexible material.

3. The apparatus of claim 2, wherein the agitator includes a motor operatively connected to a drive shaft and a plurality of blades mounted on the drive shaft.

4. The apparatus of claim 3, wherein the agitator includes an upper impeller and a lower impeller, the lower impeller including the wiping member.

5. The apparatus of claim 4, wherein the upper impeller includes a first plurality of spaced apart blades and the lower impeller includes a second plurality of spaced apart blades.

6. The apparatus of claim 5, wherein the wiping member is mounted to a lower portion of at least one of the second blades.

7. The apparatus of claim 1, further including a first pressure sensor disposed within the vessel and a second pressure sensor disposed on a discharge member adjacent and in fluid communication with a downstream surface of the filter.

8. The apparatus of claim 7, wherein the discharge member has an inverted frusto-conical shape.

9. The apparatus of claim 1, wherein the inlet is positioned at a top end of the vessel such that the substances delivered to the inner volume are gravity-fed.

10. The apparatus of claim 1, wherein the outlet is positioned at a bottom end of the vessel.

11. The apparatus of claim 1, wherein the wiping member is constructed of a friction-tempering substance.

12. The apparatus of claim 11, wherein the friction-tempering substance comprises a fluoropolymer.

13. The apparatus of claim 1, further comprising a wetting unit for continuously wetting the dry powder with liquid from the liquid supply system.

14. The apparatus of claim 13, wherein the wetting unit comprises an eductor, the eductor being configured to receive the continuous supply of dry powder from the material feed system and receive the continuous supply of liquid from the liquid supply system, the eductor having an outlet in fluid communication with the inlet of the vessel.

15. The apparatus of claim 1, further comprising a concentration-measuring detector configured to detect a concentration of the material present in the liquid exiting the inner volume through the outlet.

16. The apparatus of claim 15, wherein the concentration measuring detector is a reflectometer.

17. An apparatus for continuous make-down of a material, the apparatus comprising:

a liquid supply system including a pump operative to provide a continuous supply of liquid;

a material feed system operative to provide a continuous supply of dry powder of the material;

a wetting unit for continuously wetting the dry powder with liquid from the liquid supply system to form a mixture, the wetting unit comprising an outlet;

a vessel defining an inner volume for containing a volume of liquid, the vessel including an inlet and an outlet, the inlet being in fluid communication with the liquid supply system and the inner volume, the inlet being configured to receive the mixture from the wetting unit, the outlet being in fluid communication with the inner volume and configured to continuously deliver a dilute aqueous solution of the polymer formed in the inner volume;

a filter sealingly extending across the outlet whereby the dilute aqueous solution exiting the vessel through the outlet passes through the filter, the filter having an upstream surface within the inner volume; and an agitator disposed within the vessel and configured to agitate the inner volume, the agitator including a wiping member configured to contact the upstream surface of the filter while agitating the inner volume.

18. The apparatus of claim 17, wherein the wetting unit comprises an eductor, the eductor being configured to receive the continuous supply of dry powder from the material feed system and receive the continuous supply of liquid from the liquid supply system, the eductor having an outlet in fluid communication with the inlet of the vessel.

19. A method of continuous make-down of material, the method comprising:

continuously delivering a liquid to a wetting unit;

continuously delivering a dry powder of the material to the wetting unit;

wetting the dry powder with the liquid to form a mixture of liquid and the material;

delivering the mixture to an inner volume of a vessel;

continuously agitating the mixture contained in the inner volume of the vessel to form a solution;

continuously removing a discharge volume of the solution contained in the inner volume of the vessel while passing the discharge volume through a filter and through an outlet of the vessel, the filter having an upstream surface in contact the inner volume of the vessel; and wiping the upstream surface of the filter while agitating the mixture.

20. The method of claim 19, further comprising determining a pressure differential between the upstream surface of the filter and a downstream surface of the filter.

21. The method of claim 20, further comprising determining an upstream pressure adjacent the upstream surface of the filter with a first pressure sensor disposed within the vessel and determining a downstream pressure adjacent the downstream surface of the filter with a second pressure sensor disposed on a discharge member adjacent and in fluid communication with the downstream surface of the filter.

22. The method of claim 20, further comprising controlling an amount of mixture entering or discharge volume of the solution exiting the vessel based upon the pressure differential.

23. The method of claim 19, wherein the wiping step includes rotating at least one impeller blade having a wiping member thereon, and the wiping member contacting the upstream surface of the filter.

24. The method of claim 19, further comprising detecting a concentration of the material present in the discharge volume of the solution exiting the inner volume through the outlet.

25. The method of claim 24, wherein the detecting step is performed with a reflectometer.

* * * * *